United States Patent [19]

Norvasto

[11] Patent Number: 4,804,228

[45] Date of Patent: Feb. 14, 1989

[54] CHAIR FOR SERVICE TO CUSTOMER

[76] Inventor: Osmo Norvasto, Lusankatu 28, SF-33500 Tampere, Finland

[21] Appl. No.: 104,900

[22] PCT Filed: Jan. 30, 1987

[86] PCT No.: PCT/F187/00018

§ 371 Date: Oct. 1, 1987

§ 102(e) Date: Oct. 1, 1987

[87] PCT Pub. No.: WO87/04604

PCT Pub. Date: Aug. 13, 1987

[30] Foreign Application Priority Data

Feb. 3, 1986 [FI] Finland ..... 860475

[51] Int. Cl.[4] ..... A47C 1/06

[52] U.S. Cl. ..... 297/347; 297/349; 297/423; 248/421

[58] Field of Search ..... 297/347, 345, 346, 349, 297/423; 248/421

[56] References Cited

U.S. PATENT DOCUMENTS

| | | | |
|---|---|---|---|
| 2,849,051 | 8/1958 | Streeter | 297/347 |
| 3,236,556 | 2/1966 | Lathers | 248/421 X |
| 3,302,971 | 2/1967 | Lory | 297/347 |
| 3,807,680 | 4/1974 | Wilson et al. | 248/421 |
| 4,344,594 | 8/1982 | Hirth | 248/421 |
| 4,553,178 | 8/1985 | de Polo | 297/346 |
| 4,614,246 | 9/1986 | Masse et al. | 297/346 |
| 4,711,486 | 12/1987 | Fujiyama | 297/347 |

FOREIGN PATENT DOCUMENTS

| | | | |
|---|---|---|---|
| 1941303 | 2/1971 | Fed. Rep. of Germany | 297/347 |

*Primary Examiner*—Francis K. Zugel

*Attorney, Agent, or Firm*—Pollock, Vande Sande & Priddy

[57] ABSTRACT

A chair for rendering service to customer includes a base member affixed to a stationary support such as a floor, a seat structure and an adjustment device interposed between the base member and the seat structure for adjusting the vertical distance between the seat structure and the base member. The base member is disposed beside the seat structure seen in a horizontal direction. By operating the adjustment device which includes articulated arms and a pushing member, the seat structure is moved in a vertical direction as the adjustment members of the adjustment device are pivoting about their points of fixation. The articulated arms and the pushing member are preferably arranged to be pivoted in a horizontal plane about a vertical axis in the base member.

7 Claims, 1 Drawing Sheet

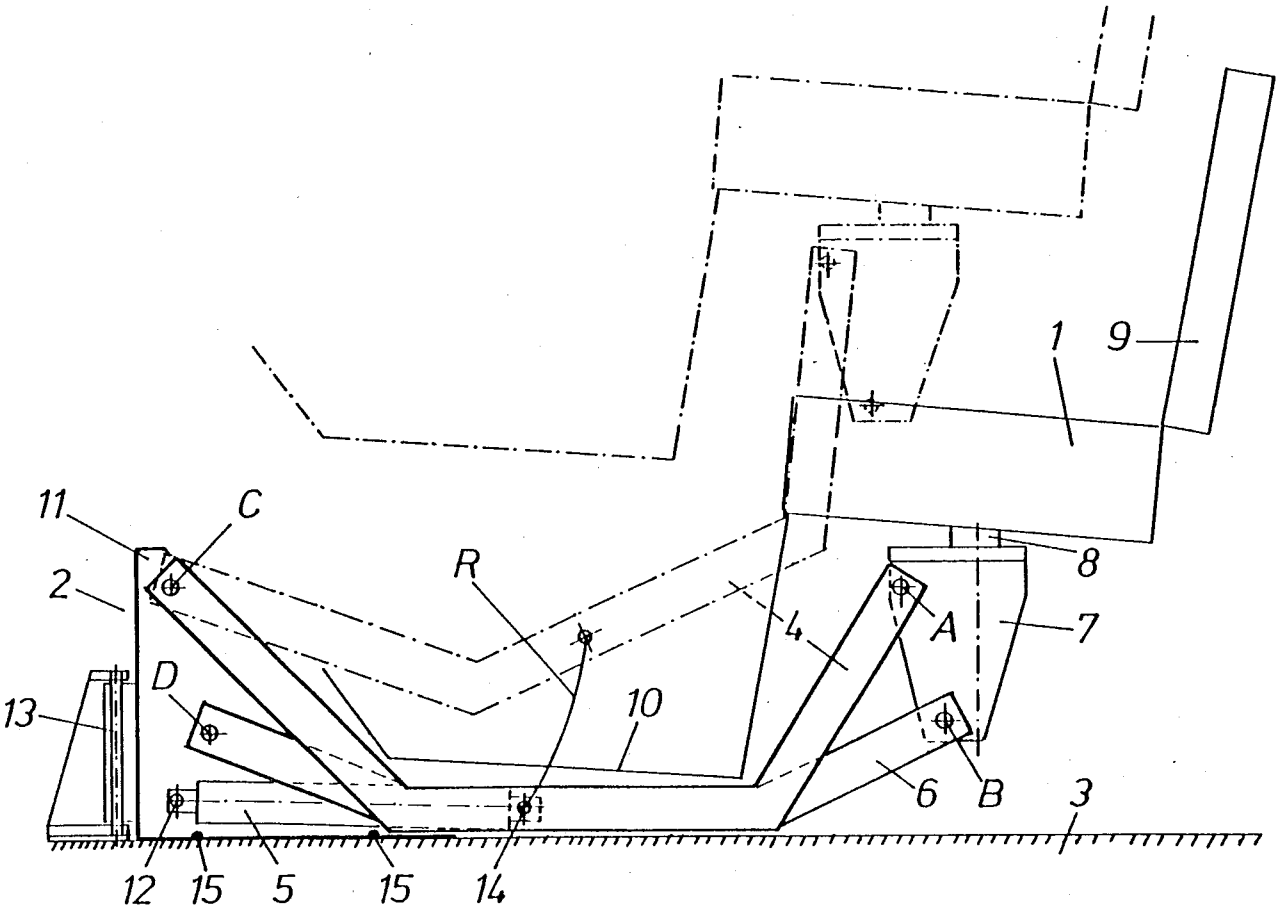
9
1
8
7
3
B
A
6
4
10
R
14
15
5
C
15
D
12
11
2
13

CHAIR FOR SERVICE TO CUSTOMER

FIELD OF THE INVENTION

The present invention relates to chairs for rendering service to customer comprising a base member affixed to a stationary, support such as a floor, a seat structure as well as means interposed between the base member and the seat structure for adjusting the vertical distance between the seat structure and the base member.

SUMMARY OF THE INVENTION

The chairs of the above type are used by barbers, hairdressers, cosmetologs and people rendering similar kinds of services to the customers. The customer chairs used nowadays have a construction, wherein the base member is placed directly beneath the seat structure and the means for adjusting the vertical distance between the seat structure and the base member comprise a cylinder-piston combination driven by a pressure means and are adjustable in length in the vertical direction. By operating this cylinder-piston-combination the seat structure can be raised and lowered. The customer chairs have also a tiltable back member.

The area covered by various movements of present chairs does not meet those requirements, that have become apparent in ergonomical researches directed to ways of carrying out various operations in work. One inconvenience, which has become evident, is that the range of adjustment of the present customer chairs in a vertical direction is too small for obtaining an ergonomically acceptable position of the worker, when the sizes of the customer and the worker have varying proportions. This drawback has become evident for example in the situations showing a combination tall worker/short customer or on the contrary. These combinations do not allow a suitable working position. For example the combination short worker/tall customer requires in the practice the lowering of the customer chair to a relatively low position. The present customer chairs do not allow this possibility, because the means interposed between the base member and the seat prevent the seat from being positioned sufficiently low. Another drawback, which is not dependent of the physical propotions between the worker and the customer, but effects all workers serving the customers, is the constructional feature, that the base member of the chair, either circular or having several legs, must be quite large for creating a sufficient support. In some cases the base member even extends outside the area of the seat structure itself. This does not allow the worker to get sufficiently close to the customer during his work and results consequently in uncomfortable and distorted working positions and can thus lead to professional diseases.

The present customer chairs involve further the drawback, that cleaning the floor is not easy due to the position of the base member. The services rendered in those professions, for which the customer chair according to the invention is intended, require cleaning after each attendance of the customer. On the other hand, keeping the working room clean is important for the convenience of the worker and the customer. It is thus advantageous, that the cleaning can be done so easily and quickly as possible.

The object of the present invention is to remove the above mentioned drawbacks. For achieving this purpose the chair for rendering service to customer according to the invention is mainly characterized in that the base member is disposed in front the seat structure seen in a horizontal direction and that the means for moving the seat structure in a vertical direction contain an arm mechanism pivotable in a vertical plane about its point of attachment in the base member.

The chair according to the present invention provides several benefits with the above described features. The customer can be raised to a sufficiently high position and correspondingly lowered low enough, so that the level of the operation of the worker is at a suitable height. In this case all various customer/worker heights-combinations, such as short customer/tall worker or on the contrary, do not form a hindrance to an acceptable working position.

Moreover, the feet of the worker do not hit a base structure of any kind, but the floor is clear under the seat structure. As a consequence of this, the worker gets sufficiently close to the object of the operation without any restrictions and can stand in normal position. The floor underneath the chair can be kept clean easily, because the chair can be lifted during the cleaning to its uppermost position.

According to one advantageous embodiment the means of the customer chair are arranged to be pivoted about a vertical axis. In this case a quite new effect is achieved, in particular in those professions of service, where the customer is subjected to different kinds of treatments during his attendance. For example, at a hair dresser's there can be a hair washing place, hair cutting place etc. positioned one beside the other, in which case the customer chair always can be rotated to that place, which contains the instruments needed for the specific operation.

In the following description the customer chair of the invention is illustrated in more detail with reference to the embodiment shown by the accompanying drawing.

The customer chair is shown in the drawing in its lowermost position with continuous lines and in its uppermost position with dotted dash lines.

DETAILED DESCRIPTION OF THE PREFERRED EMBODIMENTS

The seat structure of the chair is fixed on the shorter side AB of the articulated parallelogram ABDC at points of articulation A and B. The side CD having equal length with and being parallel to the side AB is fixed on the base member 2 of the chair (points of articulation C and D) and the base member is mounted on a stationary support such as a floor 3 or a wall.

The one of the longer sides of the parallelogram ABDC, AC, is arranged to carry the seat structure 1 and the weight of the customer therein and the other side, BD, retains the seat structure 1 in its direction when the seat structure is raised up by pivotal movement of the articulated arms 4, 6 in a vertical plane. The power needed in the raising operation is obtained through a pushing member 5 positioned between the base member 2 and the articulated arm 4 interconnecting the points of articulation A and C. The pushing member can be for example a screw shaft, a hydraulic cylinder or a similar device. The articulated arm 6 interconnecting the points of articulation B and D keeps the seat in its correct position during the raising operation.

The seat structure 1 comprises on auxiliary body 7 forming the lower part of the seat structure and containing the points of articulation A and B and a vertical shaft 8 by means of which the seat can be rotated into a suitable position by support of this shaft. The back member 9 of the seat 1 can be lowered and raised at any position of the seat and it comprises a spring for facilitating this operation in a known manner (not shown in the drawing).

The points of articulation A, B, D and C of the articulated parallelogram ABDC are journalled and connected pivotally to each other so, that they allow the movement only in the plane defined by the articulated parallelogram ABDC and prevent the seat from tilting aside. The articulated arms 4 and 6 of the parallelogram are correspondingly constructed to be sufficiently stiff for bearing the weight stably also in the case, where the seat is turned for example 90° aside from the plane defined by the articulated parallelogram and the back member 9 of the seat is tilted to its lowermost position.

The articulated arms 4 and 6 are preferably formed into a shape of a broad U with stretched legs, which shape allows the footrest 10 of the seat structure to be fitted into the U-shape in the lowermost position of the customer chair.

The base member 2 comprises preferably an auxiliary support body 11 comprising the points of articulation C and D as well as the one end 12 of the pushing member 5, all journalled in the body 11. The auxiliary support body 11 is in turn arranged to be rotatable in a horizontal plane about a vertical axis 13, and the member bearing the axis structure is fixedly secured to a stationary support such as a floor 3. With this construction the whole structure of the customer chair can be pivoted in a horizontal plane about the vertical axis 13, for example supported by rollers 15. The rollers 15 are fastened to the auxiliary support body 11.

When the seat structure 1 is raised up, the length of the pushing member 5 will increased. During this operation the seat structure 1 and the assembly 4, 5 and 6 lifting it in a vertical plane move for example to the position shown in the drawing by dotted dash lines. The one end 12 of the pushing member 5 is fastened to the auxiliary support body 11 of the base member 2 fixedly mounted on the floor and the pushing member raises the articulated arm 4 by its other end 14 secured to the arm 4. The arm 4 is pivoted upwards about its point of articulation C by the pushing member 5. The movement of the articulated arm 4 at the same time causes the raising movement of the seat structure 1 comprising the point of articulation A for securing the arm 4 to the seat structure 1. The articulated arm 6 keeps the side AB of the parallelogram ABDC in every stage parallel to the side CD and the seat 1 is raised retaining its direction. The movement of the other end 14 of the pushing member is denoted by the arc R in the drawing.

It is apparent to a man skilled in the art, that a similar function is obtained also with other kinds of constructions.

I claim:

1. A chair for rendering service to a customer comprising:

a seat structure;

a base member affixed to a stationary support, such as a floor, for supporting said seat structure, said base member being positioned in front of said seat structure seen in the horizontal direction;

adjustment means inter-connected between said base and said seat structure for adjusting the vertical distance between said seat structure and said base member;

said adjustment means including an arm mechanism having upwardly open stretched U-form and being pivotable in a vertical plane about a point of connection of said arm mechanism to said base member; and a footrest member connected to said seat structure, wherein said upwardly open arm mechanism is adapted for receiving said footrest member at least in the lowermost position of the chair.

2. A chair as claimed in claim 1 with said adjustment means is further pivotable in a horizontal plane about a vertical axis of the base member.

3. A chair as claimed in claim 1 wherein said adjustment means comprises two articulated arms which are articulated with said base member and with said seat structure and define an articulated parallelogram-like structure and a power unit interposed between one of said articulated arms and the base member for adjusting the shape of said articulated parallelogram-like structure and thereby the vertical position of said seat structure.

4. A chair as claimed in claim 2, wherein said adjustment means comprises two articulated arms, which are articulated with said base member and said seat structure and define an articulated parallelogram-like structure and a power unit positioned between one of said articulated arms and a seat structure for adjusting the shape of said articulated parallelogram-like structure and thereby vertical position of said seat structure.

5. A chair as claimed in claim 1 further comprises two articulated arems connected to said seat structure at two points A, B. at a distance from each other, wherein the seat structure is tiltable by adjusting the distance between said points A,B.

6. A chair as claimed in claim 2 further comprising two articulated arms connected to said seat structure at two articulation points A, B at a distance from each other, wherein said seat structure is tiltable by adjusting the distance between said articulation points A, B.

7. A chair as claimed in claim 2 further comprising two articulated arms connected to said seat structure at two articulation points A, B at a vertical distance from each other, wherein said seat structure is tiltable by adjusting position of one of said articulation points.

* * * * *